US008579781B2

(12) United States Patent
Sampaio Camacho

(10) Patent No.: US 8,579,781 B2
(45) Date of Patent: Nov. 12, 2013

(54) RECLOSEABLE FLEXIBLE BAG

(75) Inventor: José Manuel Sampaio Camacho, Parede (PT)

(73) Assignee: AMCOR FLEXIBLES EUROPE, Danish corporation, Horsens (DK)

( * ) Notice: Subject to any disclaimer, the term of this patent is extended or adjusted under 35 U.S.C. 154(b) by 657 days.

(21) Appl. No.: 12/323,168

(22) Filed: Nov. 25, 2008

(65) Prior Publication Data

US 2009/0145084 A1 Jun. 11, 2009

Related U.S. Application Data

(62) Division of application No. 10/531,663, filed on Apr. 15, 2005, now Pat. No. 7,708,463.

(30) Foreign Application Priority Data

Oct. 18, 2002 (EP) ..... 02292587

(51) Int. Cl.
*B31B 1/90* (2006.01)

(52) U.S. Cl.
USPC ..... 493/214; 493/213

(58) Field of Classification Search
USPC ..... 493/214, 213, 394, 221, 927
See application file for complete search history.

(56) References Cited

U.S. PATENT DOCUMENTS

| | | | | |
|---|---|---|---|---|
| 1,133,911 | A | 5/1915 | Barnard | |
| 1,619,887 | A | 3/1927 | Sapp | |
| 3,107,842 | A | 10/1963 | Guilfoyle | |
| 3,566,752 | A | 3/1971 | Dreher | |
| 3,806,024 | A | 4/1974 | Marchesani | |
| 5,078,509 | A * | 1/1992 | Center et al. | 383/88 |
| 5,407,419 | A * | 4/1995 | Kelly et al. | 602/3 |
| 5,716,135 | A | 2/1998 | Campbell | |
| 5,928,749 | A | 7/1999 | Forman | |

FOREIGN PATENT DOCUMENTS

| | | |
|---|---|---|
| DE | 10 59 277 | 6/1959 |
| FR | 2 823 722 | 10/2002 |

* cited by examiner

*Primary Examiner* — Sameh H. Tawfik
(74) *Attorney, Agent, or Firm* — Sughrue Mion, PLLC

(57) ABSTRACT

The flexible packaging (10) comprises a body (22) which has, at the outer side, at least one main face (26) which is formed at least partially by a flexible sheet (12). It comprises a reclosing strip (43) which is separate from the flexible sheet (12) and an adhesive (44) which can be reactivated by means of pressure and which is interposed between the outer surface of the flexible sheet (12) and the reclosing strip (43), the adhesive strength of the adhesive (44) to the surface of the reclosing strip (43) being greater than the adhesive strength of the adhesive (44) to the outer surface of the packaging sheet (12), the reclosing strip (43) and the packaging sheet (12) having identical structural features.

2 Claims, 5 Drawing Sheets

RECLOSEABLE FLEXIBLE BAG

CROSS-REFERENCE TO RELATED APPLICATIONS

This is a divisional of application Ser. No. 10/531,663 filed Apr. 15, 2005. The entire disclosure(s) of the prior application (s), application Ser. No. 10/531,663 is considered part of the disclosure of the accompanying divisional application and is hereby incorporated by reference.

BACKGROUND OF THE INVENTION

The present invention relates to a flexible packaging, of the type comprising a body which has, at the outer side, at least one main face which is formed at least partially by a flexible sheet.

The invention further relates to a method for producing a packaging of this type.

A large number of food products, such as powdered products, such as coffee and flour, or granular products, such as pasta and rice, are packaged in flexible packagings of the above-mentioned type. These packagings are formed from one or more welded sheets. They generally have at least one lower transverse welded seam which is arranged at the base of the body, an upper transverse welded seam which is initially arranged at the upper end of the body, and a longitudinal welded seam. In order to remove the products contained in the packaging, the upper welded seam is completely or partially broken or the upper end of the packaging is completely or partially detached. The open packaging constitutes a pocket which can be accessed from the upper end which forms a neck which delimits a passage for access to the pocket interior.

After the upper transverse welded seam has been partially removed, broken or cut, it is difficult to keep the neck closed in order to prevent the products remaining inside the pocket from spilling out.

In order to keep packagings of this type closed, it has been proposed that an adhesive strip be provided which is attached to the body and one end of which is permanently sealed to the outer face of the body of the packaging, and the other end of which can be adhesively bonded to the opposing face of the body of the packaging after the neck has been folded over on itself, thus keeping the neck compressed between the body of the packaging. An adhesive strip of this type has different properties to those of the sheet and the positioning thereof is a complex operation.

Metal tabs which are attached to the end of the neck are also known, these metal tabs comprising, at one side and the other, extensions which are plastically deformable and which allow the extensions of the tab to be folded down at one side and the other of the neck in order to retain the neck in the rolled position thereof after the neck has been rolled over on itself.

The means for retaining the rolled-over portion of the neck in order to allow the packaging to be reclosed in a secure manner are relatively costly to implement since they require external elements to be attached to the packaging.

SUMMARY OF THE INVENTION

The object of the invention is to provide a method of producing a flexible packaging which can be readily reclosed and whose production cost is low.

BRIEF DESCRIPTION OF THE DRAWINGS

The invention will be better understood from a reading of the following description, given purely by way of example and with reference to the drawings, in which.

DETAILED DESCRIPTION OF THE INVENTION

Figure 1:
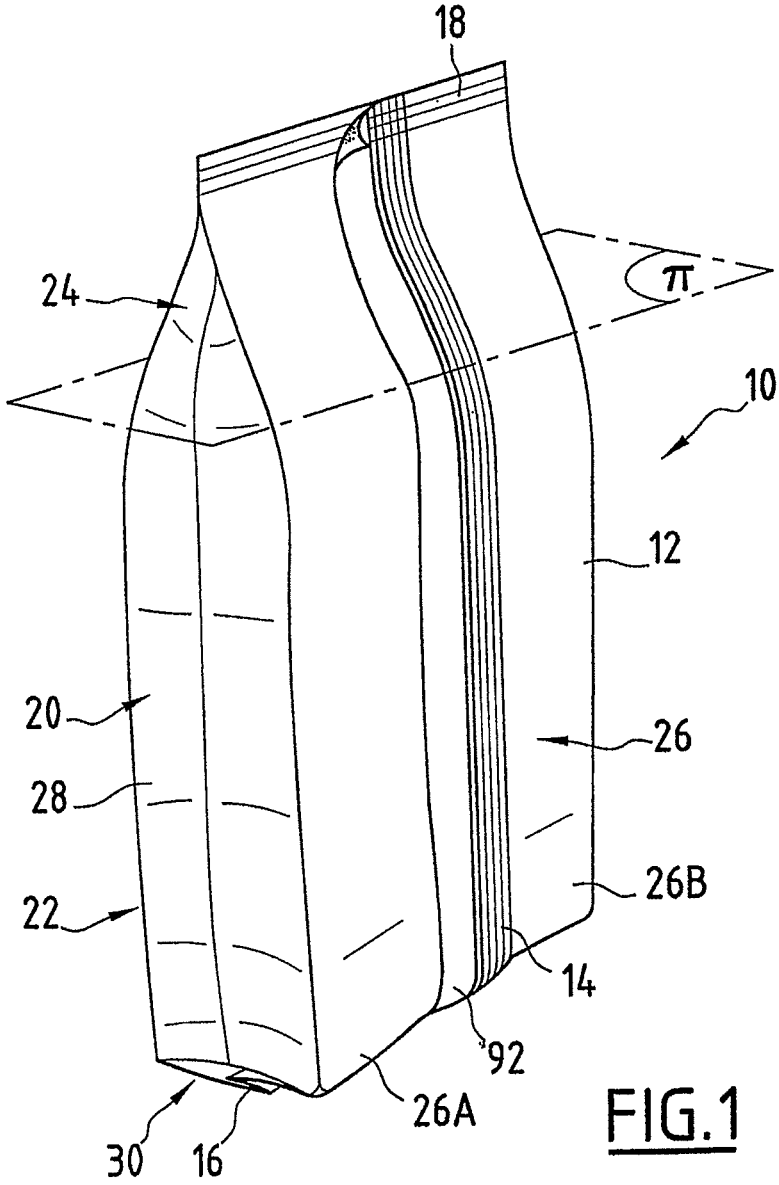
FIG. 1 is a perspective view of a packaging according to the invention, before opening.

The flexible packaging 10 illustrated in FIG. 1 is intended, for example, for packaging powdered coffee, or any other powdered or granular product, whether a food product or not.

It comprises a flexible sheet 12 which is folded over on itself in a longitudinal direction and which is fixedly joined along a longitudinal welded seam 14. The packaging is initially closed at the lower end thereof by means of a transverse welded seam 16 and, at the upper end thereof, by means of a transverse welded seam 18.

More precisely, in the embodiment illustrated, the flexible packaging 10 forms a pocket 20 which is intended to be opened at the upper end thereof. The pocket 20 comprises a body 22 which constitutes the vertical trunk of the pocket, this trunk being intended to contain the packaged products. The body 22 is extended towards the upper end of the body by means of a neck 24 which generally has no product.

The pocket 20 has two main opposing faces 26 which extend parallel with each other, and two lateral faces 28 which connect the main faces 26 and which extend parallel with each other.

The longitudinal welded seam 14 defines, on one of the main faces of the pocket, two adjacent sides 26A, 26B. These two sides are connected to each other along the height of the packaging by means of the longitudinal welded seam 14.

At the lower end, the body is closed by a base 30 which is produced by the sheet being folded. The lower transverse welded seam 16 is pressed against the base 30.

The lateral faces 28 have, at the upper end thereof, along the length of the neck 24, an inner fold which forms a gusset which allows the two main faces 26 to be brought together in the region of the upper transverse welded seam 18.

Figure 2:
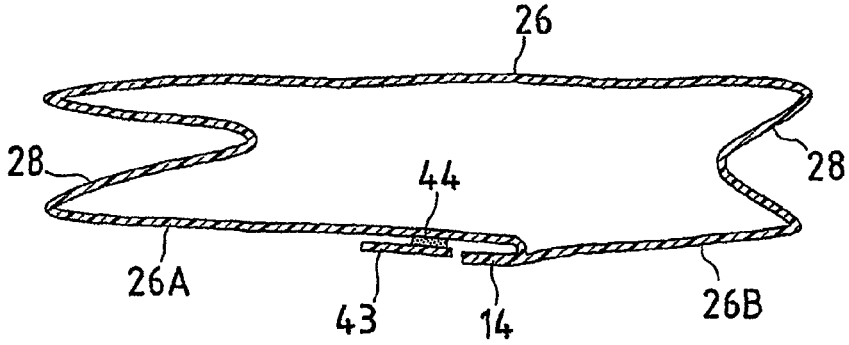
FIG. 2 is a cross-section of the packaging of FIG. 1, taken along plane π.

As illustrated in FIG. 2, the longitudinal welded seam 14 is of the type flesh against flesh, that is to say, it is produced by joining together the opposing portions of the surfaces of the sheet which delimit the interior of the packaging.

According to the invention, the packaging includes means which allow a rolled-over portion of the neck of the packaging to be retained after initial opening in order to allow the packaging to be reclosed in a secure manner.

These means for retaining a rolled-over portion of the neck comprise a reclosing strip 43 which is held against the outer surface of the sheet 12 by means of an adhesive 44 which can be reactivated by means of pressure and which is also referred to as repositionable adhesive.

The strip 43 is retained along the side 26A. In one variant, it is retained against the side 26B. More generally, the strip is retained against a main face 26.

The strip 43 extends along the entire height of the packaging, from the upper welded seam 18 to the lower welded seam 16. It extends parallel with the longitudinal welded seam 14.

In particular, the strip 43 extends above the welded seams 18 and 16. In order to prevent the strip 43 and the seams 16 and 18 from being welded, a coating 45 which prevents welding is interposed between the strip and the sheet 12 in the region of the welded seams 16, 18. This coating 45 is especially advantageous in the region of the upper welded seam 18 where the strip must be subsequently detached.

The strip 43 is constituted by the same material as that which constitutes the sheet 12. The sheet 43 thus has the same structural features as the sheet 12, that is to say, the thickness thereof is identical to that of the sheet 12, as is the composition thereof. As will be set out in detail below, the strip 43 and the sheet 12 are taken from the same initial strip.

The adhesive 44 extends only in the central portion of the strip 43, when the width thereof is considered. The lateral edges of the strip 43 thus have no adhesive.

The adhesive 44 and the opposing surfaces of the side 26A and the strip 43 are adapted so that the adhesion of the adhesive 44 to the strip 43 is greater than the adhesion of the adhesive 44 to the side 26A.

To this end, a repellent coating is advantageously applied to the outer face of the sheet 12 in the region of the strip 43 in order to reduce the adhesion between the adhesive and the sheet. In the same manner, a repellent coating is advantageously arranged on the main face 16 which does not comprise the longitudinal welded seam and which forms the face to which the strip 43 is subsequently bonded after reclosure. This coating is arranged at the location where the strip 43 is bonded.

The repositionable adhesive is constituted by: a continuous double-sided adhesive tape for application in the cold state; a hot melt for application in the heated state which can be interrupted; or a cold adhesive coating which can be interrupted.

Figure 3:
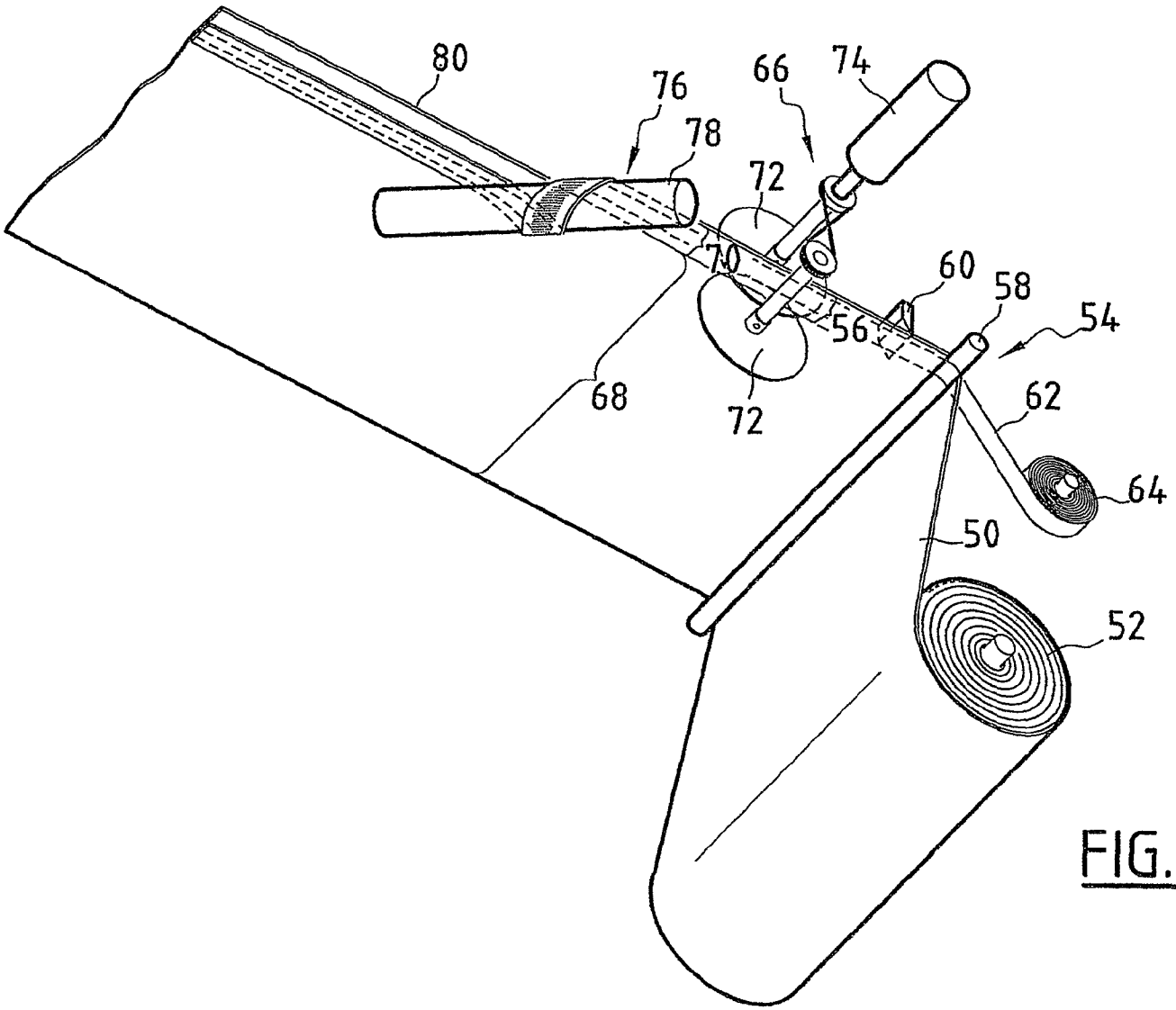
FIG. 3 is a partial perspective view of the assembly for producing the packaging of the preceding Figures.

In order to produce a packaging of this type, the assembly illustrated in FIG. 3 is used.

The packagings are produced in a continuous manner from an initial strip 50 which is packaged in a roll 52.

The strip 50 has a width greater than the width of the sheet 12 required for producing the packaging.

The strip 50 circulates in a unit 54 which allows an adhesive to be applied over a peripheral portion 56 of the initial strip.

The station 54 comprises a roller 58 for redirecting the strip, for applying and for fixing a double-sided adhesive tape 62 to the peripheral portion 56. This double-sided adhesive tape 62 is taken from a coil 64 which is arranged on a continuous dispenser. The double-sided adhesive tape constitutes a repositionable adhesive.

In one variant, the dispenser and the tape are replaced by a head 60 for hot melt coating the peripheral portion 56 in the heated state with a repositionable adhesive.

According to another variant, the strip in the form of a roll already comprises a region of repositionable adhesive. This region is constituted by a water-based adhesive which has been printed beforehand during the printing of the film.

A cutting station 66 is arranged downstream of the station 54 and is suitable for continuously separating the peripheral portion 56, to which adhesive has been applied beforehand, from the remainder of the initial strip in order to form, on the one hand, a packaging strip designated 68 and, on the other hand, a reclosing strip designated 70 in this Figure.

The cutting station 66 comprises, for example, two rotating cutting discs 72 which are engaged through the initial strip and which are caused to rotate by means of a drive motor 74.

A station 76 for displacing the reclosing strip 70 and for placing it in contact with the surface of the packaging strip 68 is arranged downstream of the cutting station 66.

This station 76 comprises, for example, a fixed roller 78 which is coated with a low-friction material, such as Teflon, and whose axis extends generally parallel with the plane of the packaging strip 68. The axis of the roller is angularly offset relative to the direction of movement of the packaging strip 68. It is arranged tangentially relative to the plane of the packaging strip 68.

The reclosing strip 70 is engaged around the roller 78, the face thereof which has no adhesive being in contact with the roller.

It will be appreciated that the assembly of FIG. 3 allows, starting from the initial strip, an initial strip whose peripheral portion 56 is provided with adhesive to be produced at the outlet of the adhesive coating station 60. This peripheral region is cut by the station 66 and separated from the packaging strip 68. The reclosing strip 70 is then displaced by the roller 78 and pressed against the surface of the packaging strip 68, with the portion thereof coated with adhesive pressed against the surface 68. The reclosing strip 70 is arranged with spacing from the edge (designated 80) of the packaging strip 68.

Owing to the fact that the strip 43 is taken from the same initial strip as the sheet 12, the opposing cut edges of the strip 43 and the sheet 12 have complementary profiles.

The packaging strip 68 to which the reclosing strip is fixedly joined is then placed around a tubular shaping device which generally has a circular cross-section. The two longitudinal edges of the sheet which is wound in this manner around the tubular shaping device are brought together and pressed one on the other along the face of the sheet which is directed towards the shaping device. The longitudinal welded seam 14 is then brought about by the longitudinal edges being clamped between two heating jaws or between an anvil and a jaw.

The packaging is produced in a manner known per se by the upper and lower transverse welded seams being produced simultaneously for two consecutive packagings and by these two packagings being separated.

Figure 4:
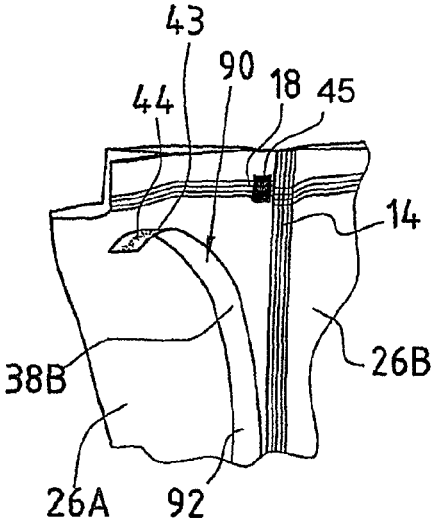
FIGS. 4, 5 and 6 are views similar to that of FIG. 1 illustrating successive steps in the closure of the packaging.
Figure 5:
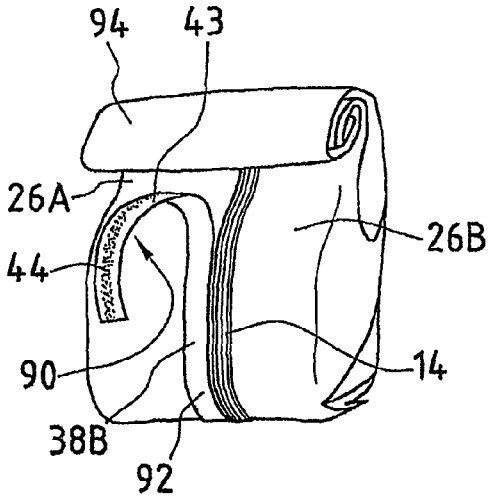
Figure 6:
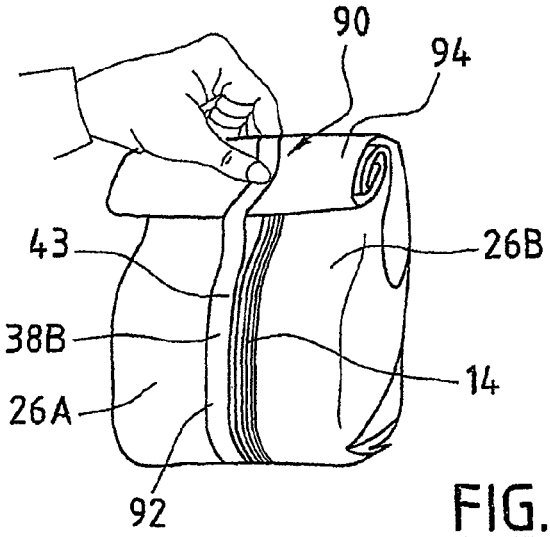

The packaging is used as illustrated in FIGS. 4 to 6.

In FIG. 4, the packaging is illustrated partially with a corner of the upper end of the neck 24 having been cut away in order to ensure partial breakage of the upper transverse welded seam 18 and thus afford access to the interior of the pocket.

The first step for reclosure of the packaging consists in the upper portion of the strip 43 being separated from the side 26A at the side of the opening.

To this end, the user grips the upper end of the strip 43 and pulls it towards the base of the packaging.

Owing to the variation in adhesion of the adhesive 44 to the surface of the strip 43 and to the side 26A, the adhesive is carried with the strip 43 and covers the central portion of the exposed surface thereof.

The detached portion of the strip, at least over the main part of the length of the neck 24, constitutes a lug 90 which is still fixedly joined to the lower portion of the body of the packaging. The base 92 of the strip which constitutes the portion which is still connected to the body of the packaging, is located substantially in the extreme filling region of the packaging.

In order to ensure that the packaging is reclosed, and as illustrated in FIG. 5, the neck 24 is folded over on itself several times in order to form a roll 94. This roll is formed along the main face 26 of the packaging having the welded seam 14. During the folding of the neck, the lug 90 coated with adhesive is retained with spacing from the roll 94.

As illustrated in FIG. 6, after the neck 24 of the packaging has been folded in order to form the roll 94 as far as the portion of the sachet which still contains some items, the lug 90 coated with adhesive is folded down transversely above and around the roll 94, the free end of the lug 90 being adhesively bonded to the main face 26 of the packaging opposite the main face which carries the welded seam 14.

It will be appreciated that the roll 94 is kept rolled by the action of the lug 90 which has been adhesively bonded on the one hand around the roll and which is fixedly joined, at each of its ends, to the main faces of the packaging.

In this position, the packaging is reclosed in a secure manner.

Figure 7:
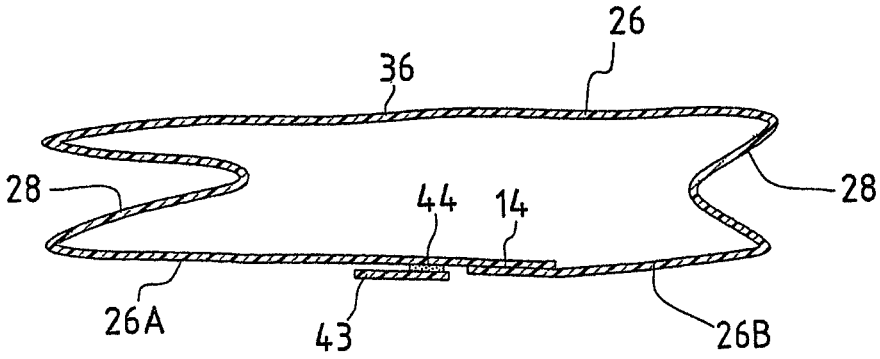
FIGS. 7 and 8 are views identical to that of FIG. 1 of production variants of the packaging according to the invention.
Figure 8:
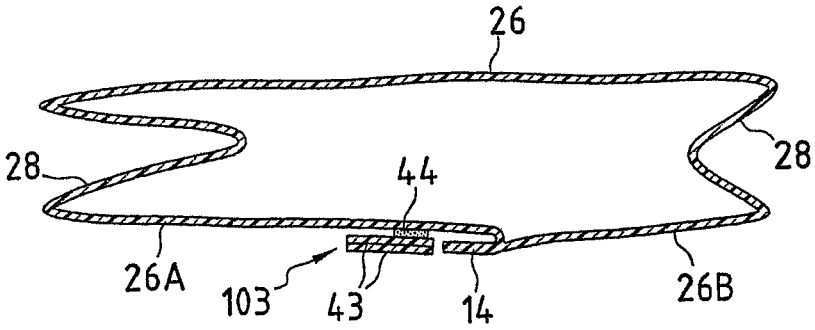
Figure 9:
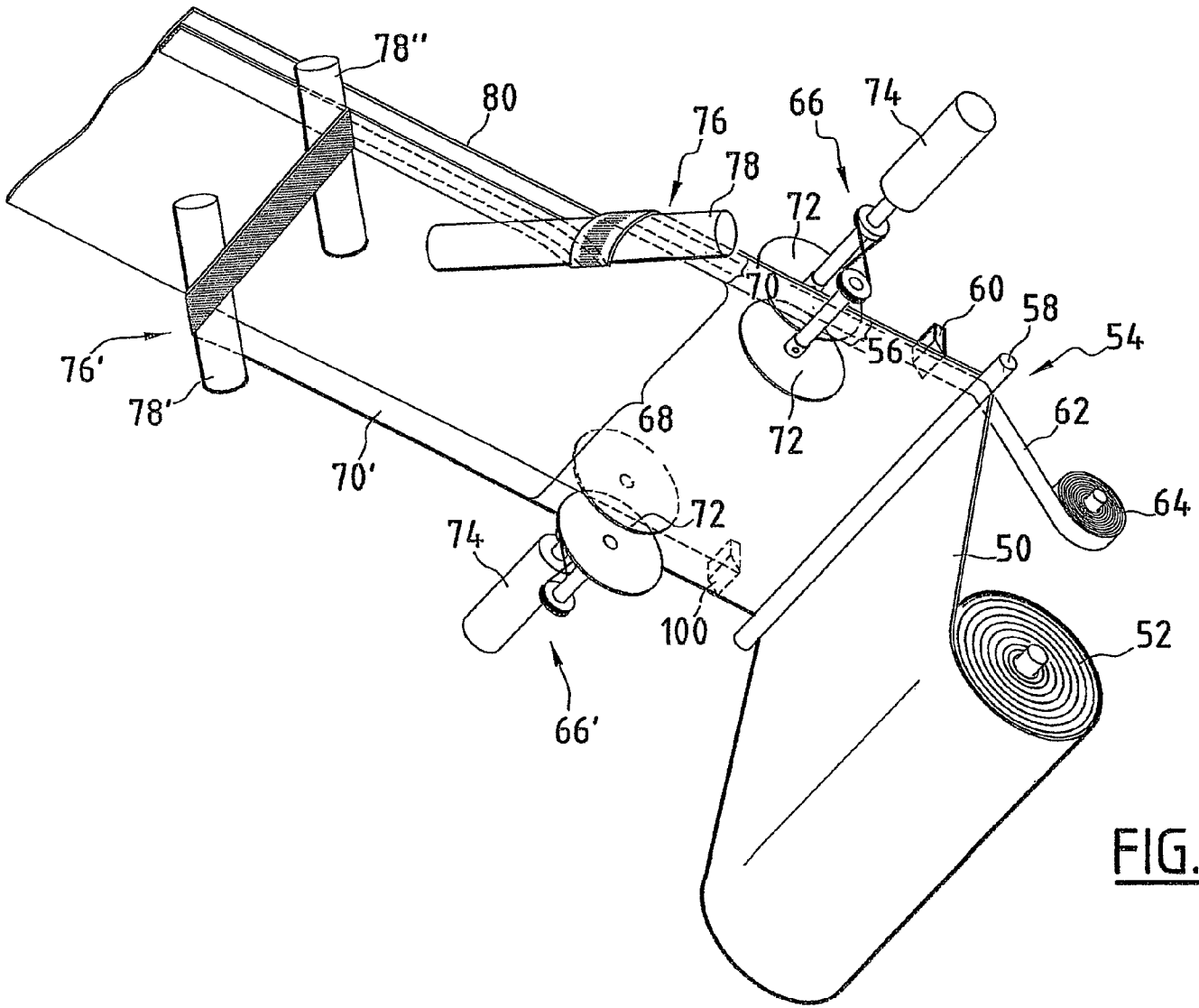
FIG. 9 is a view similar to that of FIG. 3 of the assembly for producing the packaging of FIG. 8.

FIGS. 7 and 8 illustrate production variants of a packaging according to the invention.

FIG. 7 illustrates a packaging which is formed from a single sheet whose longitudinal welded seam 14 is of the type flesh against skin, that is to say, it has been produced by the opposing surfaces of the sheet which delimit the packaging being joined together.

In this manner, only one of the sides 26B of a main face of the packaging extends at the outer side of the packaging.

FIG. 8 illustrates a production variant of the embodiment of FIG. 2.

In this embodiment, the reclosing strip designated 103 is constituted by two superimposed strips 43 which are connected to each other. One of the strips 43 is fixedly joined by means of an adhesive to the outer surface of the sheet 12. The other strip 43 is connected to the first by means of an additional adhesive which is interposed between the two strips.

In one variant, the two strips 43 are further connected to each other by means of welding in the region of the upper welded seam 18 and lower welded seam 16. These welded seams are produced simultaneously with the welded seams 18 and 16.

As illustrated in FIG. 8, the assembly for producing the packaging sheet comprises the same elements as those of the assembly of FIG. 3.

It further comprises a second cutting unit 66' which is arranged symmetrically relative to the first station 66 and which is capable of cutting a reclosing strip at the other edge of the initial strip 50. An adhesive coating station 100 for the second strip is arranged downstream of the second cutting station 66'. This station is capable of applying an adhesive which ensures the subsequent connection of the two strips 43.

A second displacement station 76' is arranged in order to bring the second strip designated 70' above the first strip designated 70. This second station comprises two rollers 78', 78" which define an angle of 45° with the direction of movement of the strip. The first roller 78' ensures that the strip changes direction by 90° relative to the direction of movement of the main strip, the second roller 78" again ensuring that the strip is displaced by an angle of 90° so that the strip comes to be pressed against the first strip 70 which has already been pressed against the packaging strip 68. The two strips 70, 70' are adhesively bonded when they are placed in contact.

An embodiment of this type is particularly advantageous when the thickness of the packaging sheet is reduced. Doubling the thickness of the reclosing strip provides greater strength thereof.

Whatever the embodiment described in this instance, it will be appreciated that the packaging can be reclosed in a secure manner, the roll which is formed from the neck not being able to unroll by itself. Furthermore, the reclosure of the packaging is ensured by very inexpensive means, this means being able to be produced simultaneously with the pocket in which the products are packaged. Finally, the positioning of the means for retaining the roll is relatively simple for the user.

The packagings are formed in a continuous manner in this instance. In one variant, however, the packagings are prefabricated and are left open at one end. They are closed and sealed at this end only after being filled.

The invention claimed is:

1. Packaging method for producing a packaging, comprising the steps of:

cutting a peripheral region of an initial strip in order to form a reclosing strip (70) and a packaging strip (68);

pressing the reclosing strip (70) against a surface of the packaging strip (68), with an adhesive which can be reactivated by means of pressure being interposed;

shaping the packaging by shaping a portion of the packaging strip (68), on which the reclosing strip (70) is retained;

forming at least one transverse welded seam at one end of the packaging; and covering the outer surface of the packaging strip, at least in a region in which the reclosing strip overlaps the transverse welded seam, with a layer which prevents welding and which is interposed between the packaging sheet and the adhesive and which prevents the reclosing strip from being welded to the surface of the packaging sheet.

2. Method according to claim 1, comprising, before the cutting step, a step of applying the adhesive in a peripheral region of the initial strip (50) which is intended to form the reclosing strip (70).

* * * * *